United States Patent [19]

Müller et al.

[11] Patent Number: 4,718,596

[45] Date of Patent: Jan. 12, 1988

[54] FOLDING TRAY

[75] Inventors: Berthold Müller, Süssen; Konrad Bantleon, Geislingen/Steige, both of Fed. Rep. of Germany

[73] Assignee: Michael Hörauf Maschinenfabrik GmbH & Co. KG, Süssen, Fed. Rep. of Germany

[21] Appl. No.: 18,418

[22] Filed: Feb. 25, 1987

[30] Foreign Application Priority Data

Apr. 17, 1986 [DE] Fed. Rep. of Germany ..... 3612998

[51] Int. Cl.[4] ..... B65D 5/24

[52] U.S. Cl. ..... 229/109; 229/170; 229/186

[58] Field of Search ..... 229/43, 109, 186, 169, 229/170, 903

[56] References Cited

U.S. PATENT DOCUMENTS

| | | | |
|---|---|---|---|
| 3,536,248 | 10/1970 | Odenhagen | 229/169 |
| 3,550,835 | 12/1970 | Persson | 229/43 |
| 3,669,340 | 6/1972 | Kinney | 229/170 |
| 3,701,467 | 10/1972 | Johansson | 229/169 |
| 4,018,378 | 4/1977 | Persson | 229/43 |

FOREIGN PATENT DOCUMENTS

| | | | |
|---|---|---|---|
| 1269941 | 6/1968 | Fed. Rep. of Germany | 229/186 |
| 2338976 | 2/1974 | Fed. Rep. of Germany | 229/170 |
| 2412335 | 9/1974 | Fed. Rep. of Germany | 229/43 |

*Primary Examiner*—Stephen Marcus
*Assistant Examiner*—Gary Elkins
*Attorney, Agent, or Firm*—Burns, Doane, Swecker & Mathis

[57] ABSTRACT

A folding tray is formed by a single foldable blank which includes a bottom wall, lateral walls, and corner sections. The lateral walls and corner elements include border sections which form a horizontal rim around the periphery of the tray. Each corner section includes a generally rectangular center part and a pair of transition sections on either side thereof. Each transition section comprises a pair of triangular parts joined to each other by a fold line and joined to the center part and associated lateral wall by fold lines. Between the center part and its associated border section is a lens-shaped equalizer section which avoids the creation of an abrupt angle between the center part and border section to enable the border section to lie flat in the erected tray. The equalizer section is defined by a pair of curved fold lines which converge to form points situated adjacent the respective transition sections.

7 Claims, 4 Drawing Figures

FOLDING TRAY

BACKGROUND OF THE INVENTION

The invention concerns a folding tray of the type formed by a single foldable blank, the blank comprising a bottom wall, foldable lateral walls, and foldable corner elements situated between adjacent lateral walls. Each corner element includes triangular folding parts joined to each other by a fold line. The lateral walls and corner elements carry foldable border sections which define a horizontal rim along the outer periphery of the erected tray.

Folding trays of this general type, which may be closed tightly by means of a cover set onto the border flange, are used, for example, for the packaging of meats or ready made meals. The trays are known to have problems in their corner zones, however. Most of the known folding trays comprise at each corner, several triangular folding parts, the apexes of which are located at the intersection of the bottom and the side walls (e.g, see the triangular parts 17, 18 of German Patent No. 28 19 708). These folding trays cannot be closed in a gas-tight manner in actual practice, as the border sections associated with the triangular folding parts must always be cut very deeply in order to make possible their folding at all. In actual practice, this cut can never be covered completely. If, on the other hand, the cut is eliminated, the paper is stretched by the folding angle to the extent that the border flange is torn.

To remedy this situation, substantially rectangular center pieces have been interposed between the triangular folding parts (e.g., see rectangular parts 10 in German Patent No. 21 33 297) so that the folding angle is reduced in the corner areas, thereby reducing the stretching of the material and diminishing the risk of tearing. In the case of these folding trays, it is often not necessary to apply cuts to the border flange. However, due to the fact that such folding trays form a circular arc at the border flange, the rectangular centerpiece is caused to curve, which, in turn, leads to a slight bulging of the border flange from its flat position. A satisfactory tight sealing of the folding tray is therefore made difficult.

It is an object of the invention to provide a folding tray of the afore-mentioned type, whereby gas-tight sealing is made possible or is facilitated by keeping the peripheral border flange flat.

SUMMARY OF THE INVENTION

This object is attained by arranging between the centerpiece of each of the corner elements and the border section carried by it, an equalizing section having fold lines which are convergent adjacent the triangular folding parts.

This equalizing section, which preferably is of lens-shaped configuration, gradually reduces the heretofore abrupt transition between the rectangular centerpiece and the border section, so that the border section associated with the rectangular centerpiece will no longer bulge appreciably from its flat position. The equalizing section further results in the rectangular centerpiece itself remaining flat, particularly if the centerpiece is joined with the tray bottom by a straight fold line. This makes it possible to simplify the folding tools. The straight line connection between the bottom and the rectangular centerpiece provides the additional advantage that the bottom of the folding tray also remains flat, which heretofore was not the case with folding trays comprising a curving fold line.

Advantageously, the border sections associated with the triangular folding parts are separated by an indentation. This indentation prevents tearing of the ready sealed tray in areas which tend to exhibit excessive stretching of the material. In view of the manner of folding, these indentations are located on the outside of the finished tray, in an area under the flange, so that no leaks may develop.

The angle between the bottom and the lateral walls is appropriately at least 105°. Larger angles are possible, while smaller angles may lead to an undesirable stretching of the material.

Advantageously, the width of the center part of the corner areas is coordinated with the dimensions of the folding tray. This may also be accomplished by the criteria that broader centerpieces lead to a less stable flange in the corner zone, while in the case of narrower centerpieces the transitions in the border flange from the triple material thickness to the single material thickness are located so close together, so that extensive stretching of the material would take place within a very small space.

BRIEF DESCRIPTION OF THE DRAWING

Further advantages and characteristics of the invention will become apparent from the description below of a preferred embodiment of the invention. In the drawings.

DETAILED DESCRIPTION OF A PREFERRED EMBODIMENT OF THE INVENTION

Figure 1:
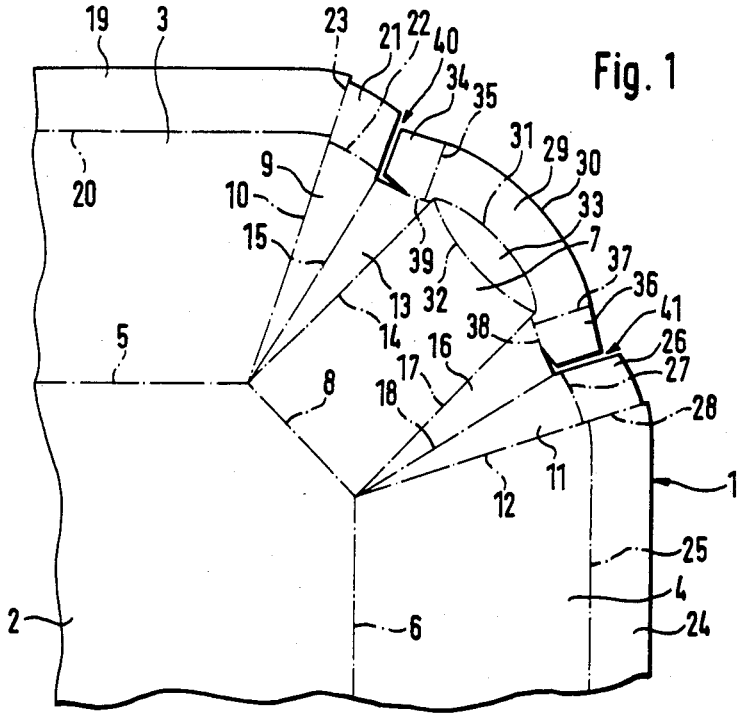
FIG. 1 shows a part of a blank of a folding tray according to the invention in the area of a corner of the tray.

The symbol 1 designates in FIG. 1 a flat blank made of cardboard coated to be suitable for sealing, with only the area of a tray corner being shown. Cut edges are indicated by sold lines and folding lines by dash-and-dot lines. All four corners of the blank are similar.

Part of the eventual tray bottom 2 is seen; it has the approximate shape of a rectangle, with two rectangular sides in the form of fold lines 5, 6 being visible in FIG. 1. The immediate corners of the rectangle forming the bottom 2 are divided by straight fold lines 8, extending at an angle of 45° to the fold lines 5, 6. Four trapezoidal lateral walls are joined to the bottom 2, of which only two of the lateral walls 3, 4 are visible in FIG. 1. The lateral wall 3 is joined to the bottom 2 by the fold line 5, and the lateral wall 4 is joined to the bottom 2 by the fold line 6.

Between the lateral walls 3, 4 (and also between the rest of the lateral walls not shown in FIG. 1) corner elements connecting the lateral walls are provided. Each corner element comprises an approximately rectangular center part 7, which is joined to the bottom 2 by the fold line 8. On either side of the center part 7 is provided a transition section, each of which defined by two adjacently located triangular parts 9, 13 and 11, 16 are disposed. The triangular folding part 9 is joined to the lateral wall 3 by a fold line 10. The triangular folding part 13 forms with the center part 7 and fold line 14. The folding parts 9, 13 are, in turn, joined by a fold line 15. In a similar manner, the triangular folding parts 11, 16 share fold lines 12, 17 with the lateral wall 4 and the center part 7, respectively, wherein the triangular folding parts 11, 16 are joined together by a folding line 18. The apexes of the triangular folding parts 9, 13 meet at a common point defined by the intersection of the bottom 2, the lateral wall 3 and the center part 7. The apexes of the folding parts 11, 16 meet at a common point defined by the intersection of the bottom 2, the lateral wall 4 and the center part 7.

The individual walls 3, 4, triangular folding parts, and center parts have border sections, which eventually form a peripheral border flange of the finished tray. Thus, a border section 19 is joined to the lateral wall 3 by a folding line 20. The triangular folding part 9 is joined to a border section 21 by a fold line 22. The border sections 19, 21 are, in turn, connected with each other by means of a fold line 23.

A border section 24 is joined to the lateral wall 4 by means of a fold line 25. A border section 26 is connected by means of a fold line 27 with the triangular folding part 11. The border sections 24, 26 are, in turn, joined by a fold line 28.

The approximately rectangular center part 7 is connected with a border section 29, the outer cut edge 30 of which forms a circular arc. A folding edge 31 connecting the center part 7 and the border section 29 comprises a circular arc with a correspondingly smaller radius.

If the border section 29 were connected directly to the center part 7 by means of the fold line 31, the peripheral border flange in the finished tray would be bulge upwardly in the area of the border section 29. In addition, the center part 7 itself would not remain flat. In order to prevent this, an approximately lens-shaped equalizing section 33 is provided between the center part 7 and the border section 29 by means of a further fold line 32. The fold lines 31, 32 converge adjacent the transition sections 9, 13 and 11, 16 such that the opposing apexes of the lens are directed toward those transition sections. The shape of the lens forming the equalizing section 33 is asymmetrical, i.e., the shapes of the fold lines 31, 32 are not identical. In that regard, the fold lines 31, 32 may be circular arcs with different radii. The fold line 32 may have a configuration other than a circular arc.

The equalizing section prevents an abrupt transition during the folding from the center part 7 to the peripheral border flange, so that the peripheral border flange remains flat even in the area of the border section 29. It also assures, in conjunction with the straight fold line 8, that the center part 7 itself remains flat.

A border section 34 is joined to the triangular folding part 13 by a fold line 39. Between the border sections 34 and 29 a fold line 35 is provided. In a corresponding manner, the triangular folding part 16 is joined to a border section 36 by a fold line 38. The border section 29 is connected by a fold line 37 to the border section 29. To prevent excessive stretching of the cardboard material after the folding of the tray, the border sections 21, 34 are separated by an indentation 40 and the border sections 26, 36 are separated by an indentation 41. The indentations 40, 41 are deep enough to cut into a portion of the fold lines 38, 39.

During the erection of the lateral walls 3, 4 and the folding of the tray, the triangular folding parts 9, 13 and 11, 16 are folded to the outside, whereby the border sections 21, 34 on the one hand, and the sections 26, 36 on the other, come to rest against each other. The indentations 40, 41 are thereby located outside the inner tray under the peripheral border flange and do not affect the sealing process. After folding, only the fold lines 10, 14, 12, 17 of the corner areas are pointing toward the inside of the container.

Figure 2:
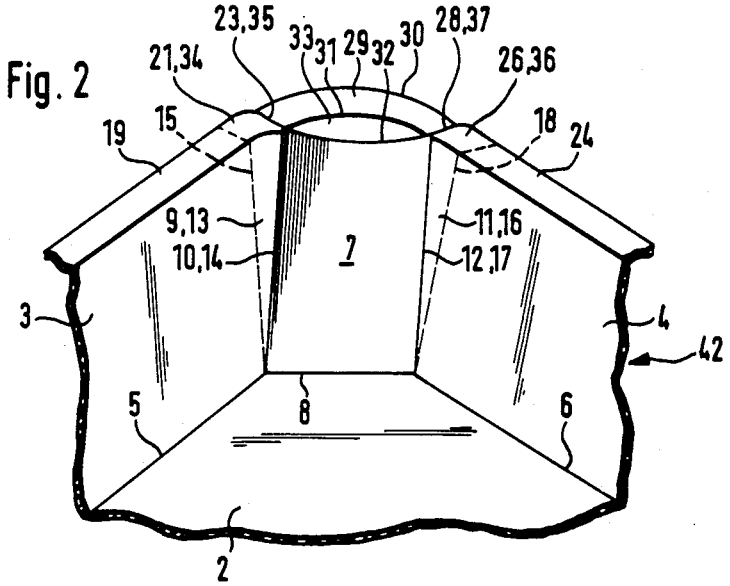
FIG. 2 is a perspective view of a tray corner folded-up from the blank of FIG. 1, as viewed from the inside.
Figure 3:
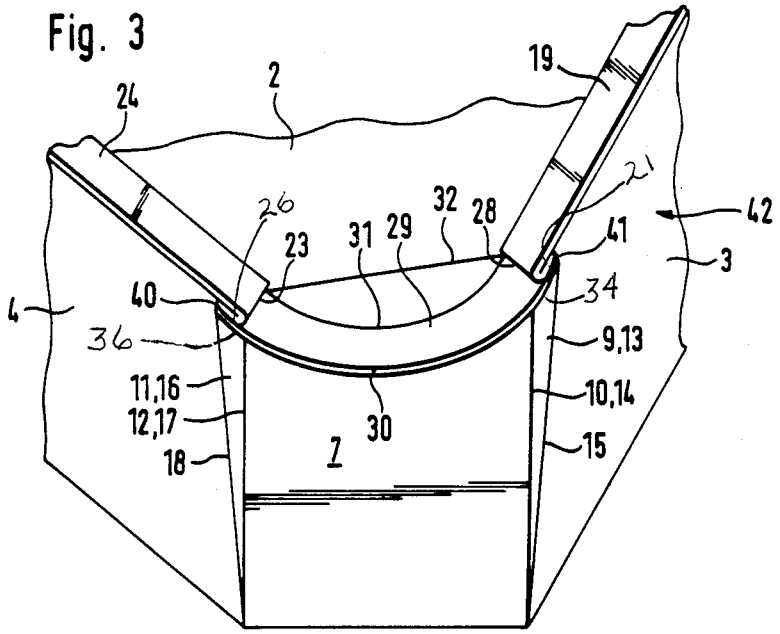
FIG. 3 is a perspective view of the folded tray corner of FIG. 2 as viewed from the outside.

This may be seen more clearly in FIGS. 2 and 3, which show perspective views of the folded container from the inside and the outside.

It is apparent in FIGS. 2 and 3 that the indentations 40, 41 are located harmlessly outside on the tray 42. It is seen further that the border section 29 is of a single-ply thickness in the area of the circular arc 30, which at its circumferential end passes into a three-ply thickness (e.g., as defined by walls 36, 26, 24 on the left side in FIG. 3, and by walls 34, 21, 19 on the right side). For this reason, it is convenient to give the border section 29 (equipped with a circular arc 30) as precise a length as possible and coordinated with the dimensions of the tray and the material thickness of the blank. In the embodiment shown, the width of the center part 7 is about 20 mm. The height of the center part 7 is about 40 mm and the dimensions of the bottom are approximately 210 mm between the fold lines 5 and 120 mm between the fold lines 6. The thickness of the blank material may be about 0.3–0.5 mm. The center part 7 remains flat after the folding step and the peripheral border flange does not bulge in the area of the border section 29, as a result of the presence of the equalizing section 33.

Figure 4:
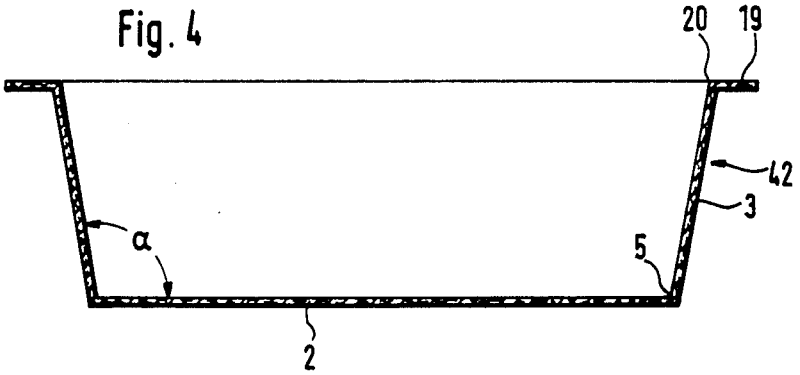
FIG. 4 is a cross-section taken through an erected folding tray outside the corner zones.

FIG. 4 shows a cross-section through the container 42 outside the corner zones and depicts the bottom 2 joined to the lateral walls 3 by the fold line 5. Also visible is the border section 19 of the peripheral border flange, which is joined by the fold line 20 to the lateral wall 3. The angle $\alpha$ between the bottom 2 and the lateral walls 3, 4 is at least 105°.

It should be mentioned for the sake of completeness that the corner zones described in FIGS. 1 to 3 are identical in all four of the corner zones of the tray.

Even though it is appropriate to coat the entire folding tray or its blank both outside and inside, it would be sufficient in some cases to coat the blank only in the area corresponding to the inside of the erected tray with a sealable layer. Coatings of aluminum, polyester, polyethylene, polypropylene and combinations of these materials, are suitable.

Although the present invention has been described in connection with a preferred embodiment thereof, it will be appreciated by those skilled in the art that additions, substitutions, modifications and deletions not specifically described, may be made without departing from the spirit and scope of the invention as defined in the appended claims.

What we claim is:

1. In a folding tray formed by a single piece foldable blank, comprising: an approximately rectangular bottom part; four lateral wall parts connected with said bottom part by fold lines; and four corner elements for joining together the lateral wall parts; each of said corner elements formed by an essentially rectangular center part, and two transition sections each comprising at least two triangular folding parts joined on either side by fold lines to the center part and one said lateral wall, respectively; said triangular parts being folded upon each other to form a transition between the center part and the lateral walls; border sections joined by fold lines to outer peripheries of said lateral wall parts and said corner elements, respectively, said border sections forming a border flange of said tray; the improvement wherein each said corner element includes an equalizing section disposed between said center part and an associated one of said border sections carried by said center part; said equalizing section joined to said center section and its associated border section, respectively, by fold lines which are convergent adjacent to the fold line joining said center part to said transition sections, respectively, to minimize bulging of said associated border section.

2. Folding tray according to claim 1, wherein said equalizing section is lens-shaped having two points defined by said convergent fold lines.

3. Folding tray according to claim 2, wherein each of said triangular folding parts is provided with one of said border sections joined thereto by a fold line which intersects said fold line formed between the respective transition section and said center part, said points of said lens-shaped equalizing section being disposed adjacent such intersections.

4. Folding tray according to claim 1, wherein said border sections associated with the triangular folding parts of each said transition section are separated from each other by an indentation.

5. Folding tray according to claim 4, wherein said bottom part forms an angle of at least 105 degrees with said lateral walls.

6. Folding tray according to claim 1, wherein a straight fold line connects each center part with the bottom.

7. Folding tray according to claim 1, wherein said equalizing section has the configuration of an asymmetrical lens, said convergent fold lines being curved about radii of different length.

* * * * *